United States Patent [19]

Furuta et al.

[11] Patent Number: 4,796,050

[45] Date of Patent: Jan. 3, 1989

[54] MECHANISM FOR DRIVING PHOTOSENSITIVE DRUMS

[75] Inventors: Hideya Furuta, Yokohama; Yoshihiro Sakai, Tokyo; Mitsuru Mamizuka, Tokyo; Fumitaka Fujieda, Tokyo, all of Japan

[73] Assignee: Ricoh Company, Ltd., Tokyo, Japan

[21] Appl. No.: 7,664

[22] Filed: Jan. 28, 1987

[30] Foreign Application Priority Data

Feb. 3, 1986 [JP] Japan ..... 61-21769

[51] Int. Cl.[4] ..... G03G 15/01

[52] U.S. Cl. ..... 355/4; 355/3 R

[58] Field of Search ..... 355/3 R, 3 DR, 4; 101/181, 183; 74/427, 665 G, 665 GE

[56] References Cited

U.S. PATENT DOCUMENTS

| | | | |
|---|---|---|---|
| 3,185,079 | 5/1965 | McGregor et al. | 74/665 GE |
| 4,214,526 | 7/1980 | Jeschke | 101/183 |
| 4,321,869 | 3/1982 | Jeschke et al. | 101/183 X |
| 4,371,253 | 2/1983 | Day et al. | 355/4 |
| 4,531,828 | 7/1985 | Hoshino | 355/4 X |

FOREIGN PATENT DOCUMENTS

| | | | |
|---|---|---|---|
| 57-85066 | 5/1982 | Japan . | |
| 60-247652 | 12/1985 | Japan | 355/3 R |
| 61-156159 | 7/1986 | Japan . | |
| 61-156158 | 7/1986 | Japan . | |
| 2185938 | 8/1987 | United Kingdom | 355/4 |

*Primary Examiner*—Arthur T. Grimley
*Assistant Examiner*—J. Pendergrass
*Attorney, Agent, or Firm*—Oblon, Fisher, Spivak, McClelland & Maier

[57] ABSTRACT

A plurality of photosensitive drums are arranged such that color-separated light images of an original document are formed respectively thereon. The photosensitive drums are independently driven under equal conditions by a single drive source for preventing image colors, i.e., image positions, from being shifted out of registry on an image transfer sheet.

1 Claim, 4 Drawing Sheets

MECHANISM FOR DRIVING PHOTOSENSITIVE DRUMS

BACKGROUND OF THE INVENTION

1. Field of the Invention

The present invention relates to a mechanism for driving photosensitive drums in a color recording apparatus.

2. Description of the Prior Art

One known type of color recording apparatus is a color copying machine. The color copying machine comprises a plurality of photosensitive drums, charging devices associated respectively with the photosensitive drums, optical systems including convergent light transmitting arrays and other members for illuminating a colored original document and exposing the photosensitive drums to unmagnified light images of the original document, image developing devices, and image transfer devices. Color-separated light images are formed respectively on the photosensitive drums and then developed into respective visible images thereon, which are thereafter transferred to a single image transfer sheet in overlapping relation (see Japanese Laid-Open Patent Publication No. 57-85066, for example).

In the above conventional copying copying machine, the colors would tend to be imposed out of register resulting in a fuzzy image if the images on the respective photosensitive drums were not exactly positioned with respect to the image transfer sheet. The reasons for such a problem is that the mechanical components of the color copying machine are manufactured with high accuracy. However, when these components are assembled and operated, they are liable to vary in their motions. For example, when the photosensitive drums make one revolution, they may rotate at the same speed on average, but variations in the speed may differ from drum to drum during the revolution of the photosensitive drums. Therefore, at the time the images are transferred successively from the photosensitive drums onto one image transfer sheet, the transferred images are apt to be out of registry since the peripheral speeds of the photosensitive drums reach their maximum and minimum levels at different times.

There has been proposed a mechanism for driving the photosensitive drums in order to prevent the images from being positioned out of registry on the image transfer sheet. This mechanism includes a plurality of gears on the respective shafts of the photosensitive drums, a train of gears positioned between and held in mesh with the gears on the drum shafts, and a single driving means such as an electric motor coupled directly or indirectly to one of the gears of the gear train. The gears of the gear train are of identical shape, molded by one mold or simultaneously integrally. When these gears are assembled, the same angular positions on the gears are required to be kept in certain phase with respect to each other according to the speed variations of the shafts of the photosensitive drums (see, for example, Japanese Laid-Open Patent Publication Nos. 61-156158 and 61-156159).

However, the prior mechanism for driving the photosensitive drums is problematic as follows: The backlash produced by each of the gears of the gear train affects the intermediate gears up to the final gear inasmuch as the gears are driven successively in series by the single motor. As a consequence, even if the relative angular positions of the gears on the drum shafts are adjusted such that these gears will vary in the speed in the same pattern, the gears start rotating at different times due to the accumulated gear backlash, with the result that the image positions on the respective photosensitive drums will reach the image transfer position at different times. In the event, the photosensitive drums are subjected to rotation irregularities as described above, the images on the photosensitive drums are caused to be out of registry with the image on the image transfer sheet.

SUMMARY OF THE INVENTION

Accordingly, it is an object of the present invention to provide a mechanism for driving photosensitive bodies such as photosensitive drums with a single electric motor, the apparatus including a means for preventing the photosensitive drums from rotating out of phase with each other, thereby to allow images to be transferred from the drums onto an image transfer sheet in registry.

According to the present invention, the above object can be achieved by a mechanism for driving a plurality of photosensitive drums in a color recording apparatus including charging devices associated respectively with the photosensitive drums, a plurality of devices associated respectively with the photosensitive drums for illuminating an original document and exposing the photosensitive drums to color-separated images of the oridinal document, image developing devices for developing latent images on the photosensitive drums into visible colored images, and image transfer devices for transferring the visible colored images from the photosensitive drums onto an image transfer sheet in overlapping relation. The mechanism comprises a single drive source having output means, a plurality of driven rotational bodies fixed to the shafts of the photosensitive drums, respectively, and common transmitting means coupled to the output means and operatively connected to the driven rotational bodies.

The driven rotational bodies are of idential dimensions and shape and are marked with indicia, respectively, at identical positions, the driven rotational bodies being angularly relatively positioned, using said indicia, on the shafts of the photosensitive drums dependent on the phase of speed variations of the photosensitive drums.

Rotative power from the single drive source via the common transmitting means to the driven rotational bodies of the photosensitive drums under equal conditions.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENT

Figure 1:
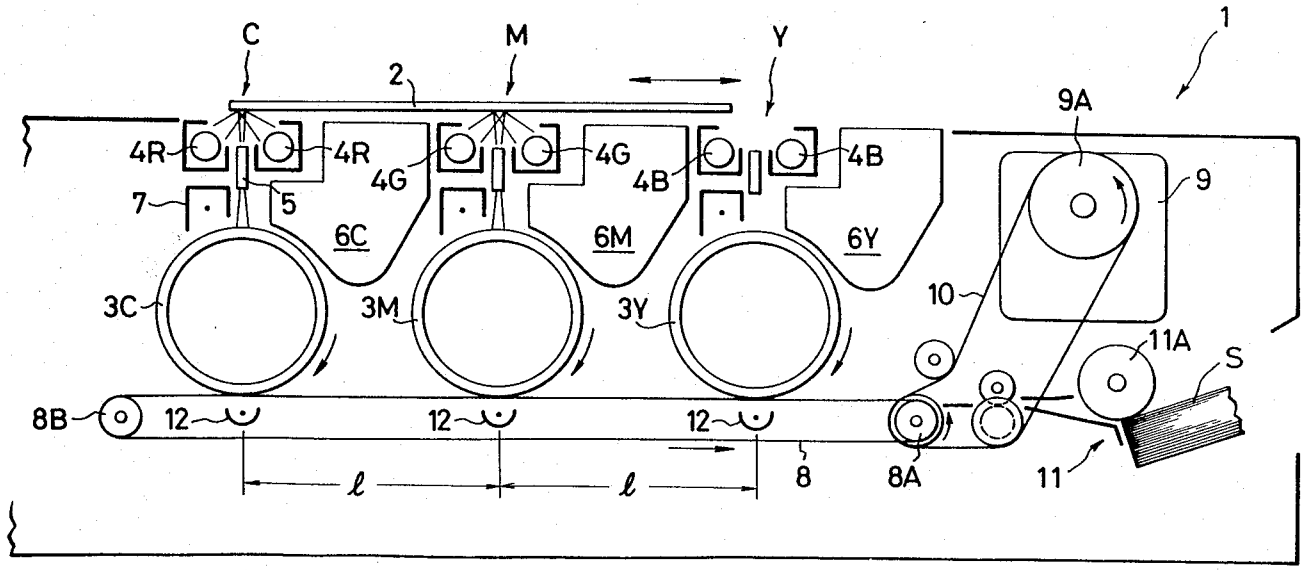
FIG. 1 is a schematic side elevational view of a color recording apparatus incorporating the principles of the present invention.

FIG. 1 illustrates a color copying machine as a color recording apparatus in which a mechanism for driving a series of photosensitive bodies or drums according to the present invention is incorporated. Another color recording apparatus to which the principles of the present invention are applicable is a color printer.

As shown in FIG. 1, the color copying machine, generally designated by the reference numeral 1, has on its upper surface a document support table 2 made of a transparent material such as glass. The document support table 2, which supports a colored document thereon, is movable by a drive mechanism (not shown) between a home position (on the lefthand side) and an actuated position.

The color copying machine 1 includes three photosensitive drums 3C, 3M, 3Y disposed in in its housing parallel to each other, the drums being rotatable clockwise about their own axes, respectively. The photosensitive drums 3C, 3M, 3Y are of the same outside diameter, and their central axes are spaced by a distance l which is equal to half of the circumferential length of each of the drums. Between the photosensitive drums 3C, 3M, 3Y and the document support table 2, there are positioned document illuminating devices 4R, 4G, 4B for illuminating the document support table 2 with red, green, and blue lights, respectively, convergent light transmitting bodies 5 for applying light reflected from the document support table 2 to the photosensitive drums, and main charging devices 7 for precharging the photosensitive drums 3C, 3M, 3Y, respectively.

In FIG. 1, the document support table 2 is moved to the right from the home position. When the document support table 2 reaches a C station, the colored image of the colored document placed on the document support table 2 is separated into a red image to which the photosensitive drum 3C is exposed through the document illuminating device 4R and the convergent light transmitting body 5. Since the photosensitive drum 3C has been charged by the associated main charging device 7, an electrostatic latent image corresponding to the red image is formed on the photosensitive drum 3C by exposure to the red image. This electrostatic latent image is then developed into a visible image by an image developing device 6C which supplies cyan toner. Then, in an M station, the photosensitive drum 3M is exposed to a green image through the document illuminating device 4R and the convergent light transmitting body 5, thus forming an electrostatic latent image corresponding to the green image on the photosensitive drum 3M. The electrostatic latent image is then developed into a visible image by an image developing device 6M which supplies magenta toner. Finally, a blue image is applied by the document illuminating device 4B and the convergent light transmitting body 5 to the photosensitive drum 3Y in a Y station to form an electrostatic latent image corresponding to the blue image on the photosensitive drum 3Y. The electrostatic latent image is then developed into a visible image by an image developing device 6Y which supplies yellow toner.

A conveyor belt 8 trained around a pair of pulleys 8A, 8B is disposed in confronting relation to the photosensitive drums 3C, 3M, 3Y downstream of the image developing devices 6C, 6M, 6Y in the direction in which the drums are rotated. The conveyor belt 8 has its upper run positioned closely to the circumferential surfaces of the photosensitive drums 3C, 3M, 3Y, the upper run of the conveyor belt 8 being movable in the same direction as that in which the drums are rotated in the vicinity of the conveyor belt 8. One of the pulleys 8A is rotated counterclockwise about its own axis in the direction of the arrow by a belt 10 trained around the pulley 8A and a pulley 9A of a main motor 9.

A sheet feeder 11 positioned rightwardly (FIG. 1) of the conveyor belt 8 contains a stack of image transfer sheets S which are fed one at a time toward the conveyor belt 8 upon rotation of a sheet feed roller 11A. The image transfer sheet S is transferred by the conveyor belt 8 into successive contact with the circumferential surfaces of the photosensitive drums 3C, 3M, 3Y during which time the yellow toner image, the magenta toner image, and the cyan toner image are sequentially transferred by image transfer chargers 12 onto the image transfer sheet S in overlapping relation. After the images have been transferred, the image transfer sheet S is passed through an image fixing device (not shown) and discharged as a colored copy out of the color copying machine 1.

Figure 2:
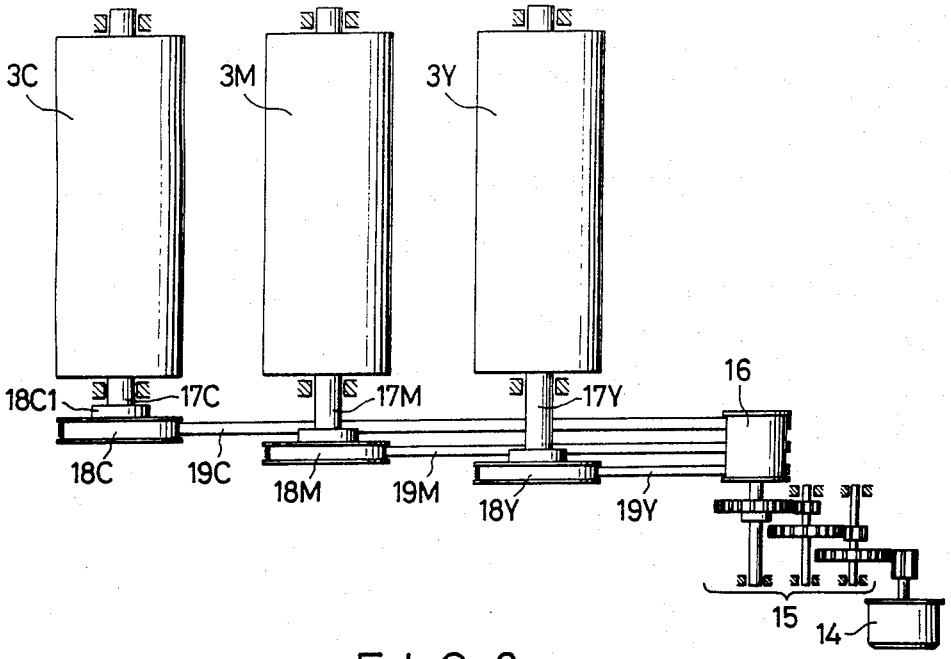
FIG. 2 is a plan view of a mechanism for driving photosensitive bodies according to an embodiment of the present invention.
Figure 3:
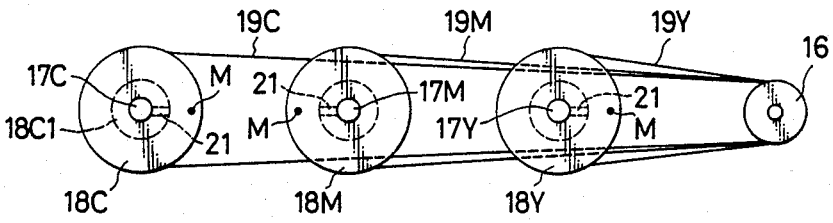
FIG. 3 is a front elevational view of the mechanism shown in FIG. 2.

FIG. 2 shows a mechanism for driving photosensitive bodies or drums according to an embodiment of the present invention. The mechanism includes a single electric motor 14, a speed reducer gear train 15, a single smaller-diameter pulley 16, and larger-diameter pulleys, or driven rotational bodies, 18C, 18M, 18Y mounted respectively on the shafts 17C, 17M, 17Y of the photosensitive drums 3C, 3M, 3Y. The speed reducer gear train 15 has its input gear meshing with a gear on the output shaft of the motor 14. The smaller-diameter pulley 16 is mounted on the shaft of the output gear of the speed reducer gear train 15. The larger-diameter pulleys 18C, 18M, 18Y are fitted over the respectively shafts 17C, 17M, 17Y of the photosensitive drums 3C, 3M, 3Y, and the bosses of the larger-diameter pulleys 18C, 18M, 18Y are fixed to the shafts 17C, 17M, 17Y, respectively, by setscrews 21 (FIG. 3).

Endless belts 19C, 19M, 19Y are trained around the larger-diameter pulleys 18C, 18M, 18Y, respectively, and the smaller-diameter pulley 16. Thus, rotative power from the motor 14 can be transmitted via the smaller-diameter pulley 16 to the larger-diameter pulleys 18C, 18M, 18Y under equal conditions.

Figure 4:
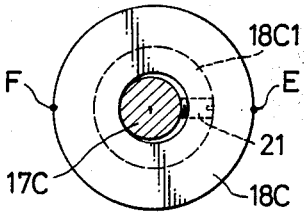
FIG. 4 is a front elevational view of a driven rotational body in the mechanism.

When the larger-diameter pulleys 18C, 18M, 18Y are fixed to the shafts 17C, 17M, 17Y of the photosensitive drums, the pulleys 18C, 18M, 18Y are displaced off center with respect to the shafts 17C, 17M, 17Y. For example, as shown in FIG, 4, even if the axial hole of the pulley 18C and the shaft 17C are made with high dimensional accuracy, the pulley 18C is brought out of coaxial alignment with the shaft 17C when they are fixed by the setscrew 21 since there is a clearance required between the pulley 18C and the shaft 17C to enable the pulley 18C to be fitted over the shaft 17C. Such a displacement of the pulley 18C is responsible for variations in the peripheral speed of the pulley 18C upon rotation thereof. More specifically, as illustrated in FIG. 4, the peripheral speed is higher in a position E and smaller in a position F, and hence the peripheral speed of the pulley 18C is not constant.

Figure 5:
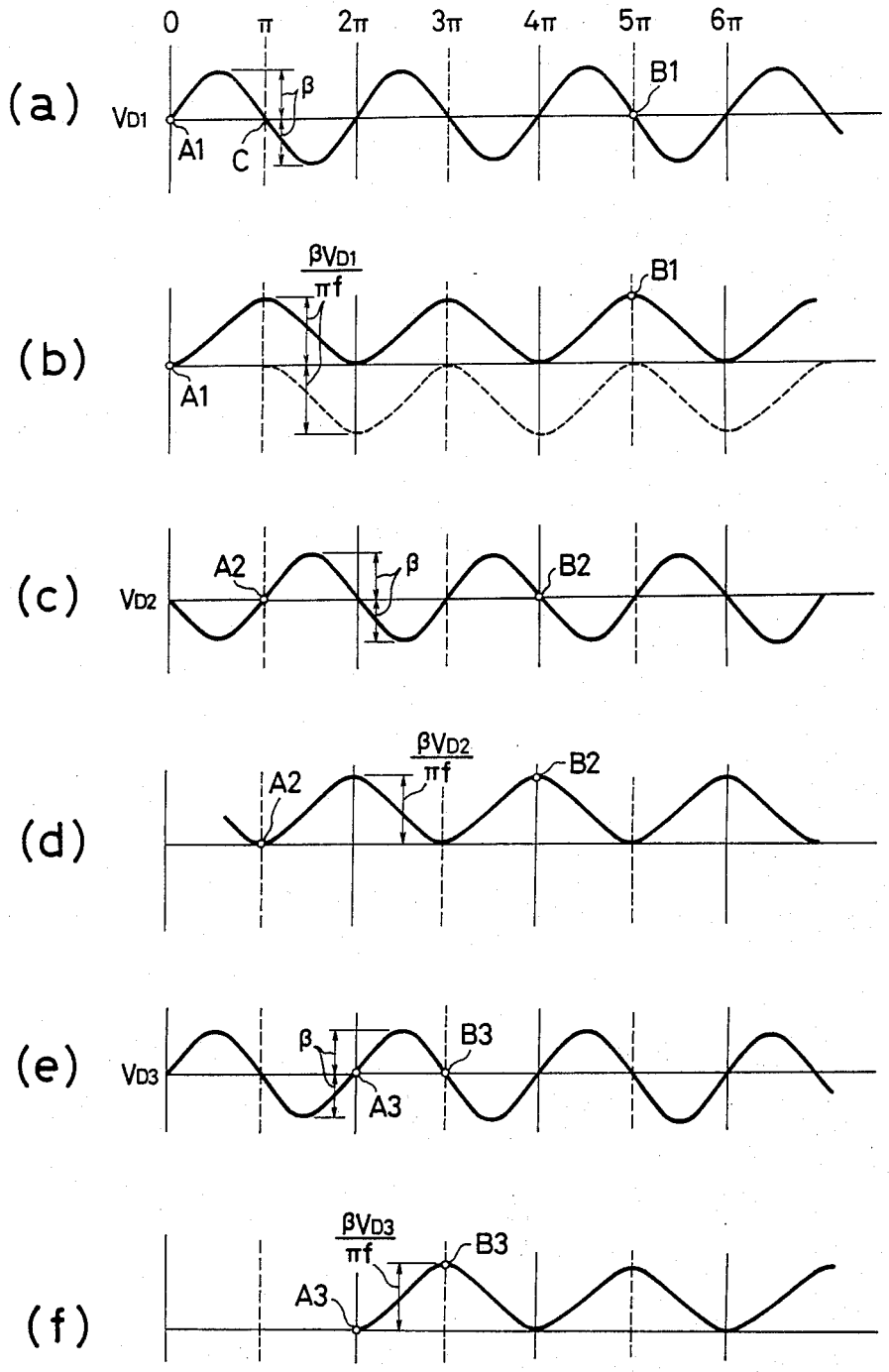
FIG. 5 is a diagram showing speed deviations and positional variations of the photosensitive bodies or drums.

The peripheral speed of the pulley 18C varies periodically as shown in FIG. 5. FIG. 5 shows such periodic speed variations of the photosensitive drums 3C, 3M, 3Y, respectively, at (a), (c), and (e). The horizontal axes represent the angle of rotation and the vertical axes the degree of speed variations. FIG. 5 also shows the angular displacements of the photosensitive drums 3C, 3M, 3Y, respectively, at (b), (d) and (f), when they have no periodic speed variations. The horizontal axes represent the angle of rotation and the vertical axes denote the angular displacement.

FIGS. 1 and 5 indicate that the photosensitive drum 3C reaches the image transfer position when it makes 2.5 revolutions, the photosensitive drum 3M reaches the image transfer position when it makes 1.5 revolutions, and the photosensitive drum 3Y reaches the image transfer position when it makes 0.5 revolution after exposure in the color copying machine. If the speed variations and the angular displacements of the photosensitive drums 3C, 3M, 3Y are the same when the circumferential points of the drums reach the image transfer position, then the superimposed images on the image transfer sheet are not brought out of registry.

Therefore, the period, amplitude, and phase of the speed variations of the photosensitive drums should be selected as shown in FIG. 5. More specifically, the photosensitive drum 3C is exposed to the document image at a point A1 in FIG. 5 at (a) and (b), and is brought to a point B1 after it makes 2.5 revolutions. At the point B1, the speed variation is zero, and the angular displacement is of a maximum value $\beta VD1/\pi f$ where $\beta$ is the maximum speed variation (%), VD1 is the average peripheral speed (mm/sec) of the photosensitive drum 3C, and f is the frequency (Hz) of the speed variations. The broken-line curve in FIG. 5(*a*) is plotted when the drum starts from a point C.

The photosensitive drum 3M is exposed to the document image at a point A2 in FIG. 5 at (c) and (d), and is brought to a point B2 after it makes 1.5 revolutions. At the point B2, the speed variation is zero, and the angular displacement is of a maximum value $\beta VD2/\pi f$ where VD2 is the average peripheral speed (mm/sec) of the photosensitive drum 3M, with VD2 = VD1.

The photosensitive drum 3Y is exposed to the document image at a point A3 in FIG. 5 at (e) and (f), and is brought to a point B3 after it makes 0.5 revolution. At the point B3, the speed variation is zero, and the angular displacement is of a maximum value $\beta VD3/\pi f$ where VD3 is the average peripheral speed (mm/sec) of the photosensitive drum 3Y, with VD3=VD2 =VD1.

The images are superimposed in exact registry on the image transfer sheet by designing or considering the relative rotational positions of the photosensitive drums, the gears, and the pulleys such that the period, amplitude, and phase of the speed variations of the drums will be of the relationship as shown in FIG. 5.

In order to prevent the images on the image transfer sheet from being displaced out of registry, the larger-diameter pulleys 18C, 18M, 18Y are of identical dimensions by being molded simultaneously integrally or by one mold.

Figure 6:
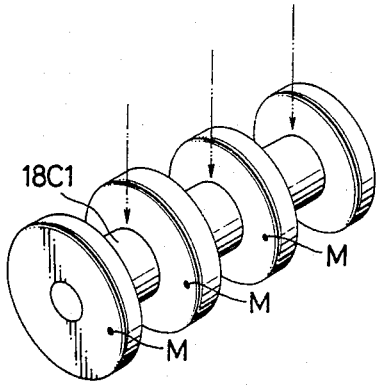
FIG. 6 is a perspective view of the driven rotational body.

FIG. 6 shows an integral assembly of simultaneously molded pulleys. These integrally molded pulleys are marked with indicia M at identical positions thereon, and then cut off at positions indicated by two-dot-and-dash lines. Thereafter, threaded holes are formed in bosses 18C1 in alignment with the marks M. The setscrews 21 will be threaded into these threaded holes.

The larger-diameter pulleys 18C, 18M, 18Y thus produced have identical speed variations per period. Thereafter, the larger-diameter pulleys 18C, 18M, 18Y are relatively angularly positioned on the respective drum shafts so that the marks M are positioned as shown in FIG. 3. After the pulleys 18C, 18M, 18Y have been assembled on the drum shafts 17C, 17M, 17Y as illustrated in FIG. 3, the pulleys 18C, 18M, 18Y are fixed thereto by the setscrews 21. By thus arranging the pulleys 18C, 18M, 18Y, the photosensitive drums 3C, 3Y are angularly positioned in phase with each other and the photosensitive drum 3M is angular positioned 180° ($\pi$) out of phase with the other drums.

Through the aforesaid fabrication and positional arrangement of the larger-diameter pulleys 18C, 18M, 18Y, the speed variation $\beta$ was in the range of from 0.05 to 0.1%, and any out-of-registry image deviation was reduced to 0.1 m/m or below, resulting in the formation of good color images. When the larger-diameter pulley 18M for driving the photosensitive drum 3M was positioned in phase with the other pulleys, images were displaced out of registry by about 0.2 m/m, which was poorer than the above image deviation.

In the foregoing embodiment, the smaller-diameter pulley 16 and the gears of the speed reducer gear train 15 which affects the rotation of the pulley 16 are designed to rotate from the exposure positions A1, A2, A3 (FIG. 5) in a period which is (1/an even number) times the period of rotation of the larger-diameter pulleys 18C, 18M, 18Y, in order that the speed variations of the photosensitive drums are in phase with each other and the photosensitive drums will not give rise to positional image deviation in the image transfer position. In reality, no positional image deviation occurred though the speed variation was about 0.3% in the above arrangement.

The principles behind the above-described attachment of the larger-diameter pulleys are disclosed in Japanese Laid-Open Patent Publication Nos. 61-156158 and 61-156159.

Figure 7:
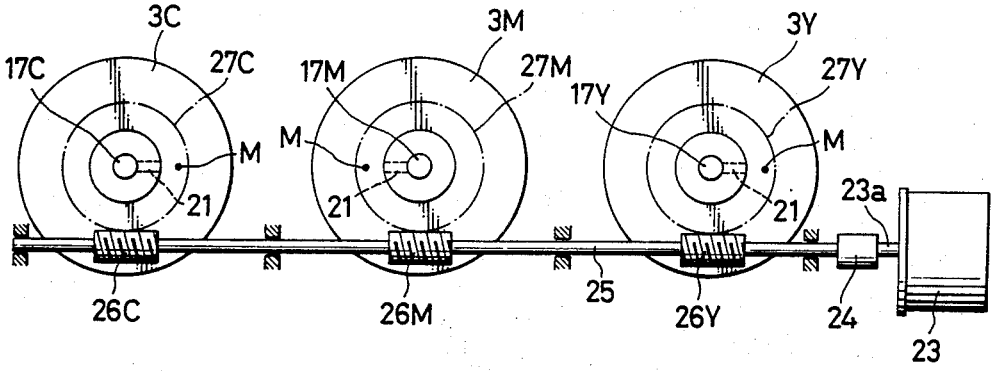
FIG. 7 is a front elevational view of a mechanism for driving photosensitive bodies according to another embodiment of the present invention.

FIG. 7 shows a mechanism for driving photosensitive bodies or drums according to another embodiment of the present invention. The mechanism shown in FIG. 7 includes a single electric motor 23, a single drive shaft 25 connected by a coupling 24 to the output shaft of the motor 23, a plurality of worms 26C, 26M, 26Y fixedly mounted at spaced intervals on the drive shaft 25, and a plurality of worm wheels 27C, 27M, 27Y fixed to the shafts 17C, 17M, 17Y, respectively, of the photosensitive drums 3C, 3M, 3Y and held in mesh with the worms 26C, 26M, 26Y, respectively. The worm wheels 27C, 27M, 27Y are secured to the shafts 17C, 17M, 17Y of the photosensitive drums 3C, 3M, 3Y by the setscrews 21 in the manner described above.

Rotative power from the motor 23 is transmitted by the worms 26C, 26M, 26Y on the drive shaft 25 to the worm wheels 27C, 27M, 27Y of the photosensitive drums 3C, 3M, 3Y under equal conditions.

The driving mechanisms shown in FIGS. 2 and 7 are simple in structure since no conventional intermediate gears are required for driving the three photosensitive bodies or drums with the single electric motor.

With the arrangement of the present invention, a single common transmission means is employed to transmit rotation to driven rotational bodies of a plurality of photosensitive drums for thereby driving the photosensitive drums with a single drive source. Therefore, the driven rotational bodies are rotated under equal conditions and hence free of rotational irregularities. In the absence of rotation irregularities, the photosensitive drums are rotated in phase with each other for thereby preventing images from being superimposed out of registry on an image transfer sheet.

Although certain preferred embodiments have been shown and described, it should be understood that many changes and modifications may be made therein without departing from the scope of the appended claims.

What is claimed is:

1. A mechanism for driving a plurality of photosensitive drums in a color recording apparatus including charging devices associated respectively with the photosensitive drums, a plurality of devices associated respectively with the photosensitive drums for illuminating an original document and exposing the photosensitive drums to color-separated images of the original document, image developing devices for developing latent images on the photosensitive drums into visible colored images, and image transfer devices for transferring the visible colored images from the photosensitive drums onto an image transfer sheet in overlapping relation, said mechanism comprising:

a single drive source having output means;

a plurality of driven rotational bodies which are substantially integral with said photosensitive drums, respectively; and common transmitting means coupled to said output means for transmitting drive power from said single drive source to said driven rotational bodies under equal conditions wherein said driven rotational bodies are of identical dimensions and shape and are marked with indicia, respectively, at identical positions, said driven rotational bodies being angularly relatively positioned, using said indicia, on shafts of said photosensitive drums dependent on a phase of speed variations of the photosensitive drums.

* * * * *